US007847748B1

(12) United States Patent
McKinley et al.

(10) Patent No.: US 7,847,748 B1
(45) **Date of Patent: *Dec. 7, 2010**

(54) SINGLE INPUT CIRCULAR AND SLANT POLARIZATION SELECTIVITY BY MEANS OF DIELECTRIC CONTROL

(75) Inventors: William S. McKinley, Clermont, FL (US); Jeffery A. Dean, Clermont, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 346 days.

This patent is subject to a terminal disclaimer.

(21) Appl. No.: 11/685,469

(22) Filed: Mar. 13, 2007

Related U.S. Application Data

(63) Continuation-in-part of application No. 11/472,151, filed on Jun. 20, 2006, now Pat. No. 7,535,432, application No. 11/685,469, which is a continuation-in-part of application No. 11/428,802, filed on Jul. 5, 2006, now abandoned, application No. 11/685,469, which is a continuation-in-part of application No. 11/455,731, filed on Jun. 20, 2006, now Pat. No. 7,518,467.

(60) Provisional application No. 60/782,363, filed on Mar. 14, 2006, provisional application No. 60/696,828, filed on Jul. 5, 2005.

(51) Int. Cl.
*H01Q 19/00* (2006.01)

(52) U.S. Cl. ..... 343/756

(58) Field of Classification Search ..... 343/850, 343/853, 767, 700 MS, 881, 915, 815, 756
See application file for complete search history.

(56) References Cited

U.S. PATENT DOCUMENTS

| | | | | |
|---|---|---|---|---|
| 4,291,278 | A | 9/1981 | Quine | |
| 4,359,741 | A | 11/1982 | Cassel | |
| 5,608,409 | A | 3/1997 | Rilling | |
| 6,335,662 | B1 * | 1/2002 | Del Rosario et al. | 333/111 |
| 6,788,165 | B2 | 9/2004 | Runyon | |
| 6,864,837 | B2 | 3/2005 | Runyon et al. | |
| 6,875,369 | B1 | 4/2005 | Tidrow et al. | |
| 7,071,881 | B1 * | 7/2006 | McKinley et al. | 343/700 MS |
| 7,126,553 | B1 * | 10/2006 | Fink et al. | 343/767 |
| 7,161,200 | B2 | 1/2007 | Baniecki et al. | |
| 7,202,734 | B1 * | 4/2007 | Raab | 330/126 |
| 7,205,955 | B2 | 4/2007 | Shirosaka et al. | |
| 7,215,284 | B2 | 5/2007 | Collinson | |
| 7,298,332 | B2 | 11/2007 | Ryken, Jr. et al. | |
| 2004/0017326 | A1 | 1/2004 | Merrill | |
| 2004/0178862 | A1 | 9/2004 | Kaplan | |
| 2004/0178943 | A1 * | 9/2004 | Niv | 342/29 |

OTHER PUBLICATIONS

Varadan, V. K., et al., "Design and development of electronically tunable microstrip antennas", *Smart Mater. Struct.8*, 1999 IOP Publishing Ltd.,(Feb. 10, 1999),238-242.

* cited by examiner

*Primary Examiner*—Huedung Mancuso
(74) *Attorney, Agent, or Firm*—Jeffrey D. Myers; Justin R. Jackson; Timothy D. Stanley

(57) ABSTRACT

An antenna and a method of creating multiple polarization states in an antenna comprising providing to the antenna a single power input, dividing the power received from the single power input, and transmitting the divided power to a radiating element via a plurality of transmission lines.

20 Claims, 2 Drawing Sheets

QUARTZ SUBSTRATE 12
LOWER Au LAYER 14
BST DEPOSITION 16
UPPER Au LAYER 18
SILICON NITRIDE CAP 20

SINGLE INPUT CIRCULAR AND SLANT POLARIZATION SELECTIVITY BY MEANS OF DIELECTRIC CONTROL

CROSS-REFERENCE TO RELATED APPLICATIONS

This application is a continuation-in-part application of the following three U.S. patent applications: (1) Ser. No. 11/472,151, entitled "Universal Antenna Polarization Selectivity via Variable Dielectric Control", to Jeffery A. Dean, et al., filed on Jun. 20, 2006, which claimed priority to U.S. Provisional Patent Application Ser. No. 60/782,363, filed on Mar. 14, 2006; (2) Ser. No. 11/428,802, entitled "Variable Differential Power Division to Improve Reciprocal RF Power Distribution Efficiency", to William S. McKinley, et al., filed on Jul. 5, 2006, which claimed priority to U.S. Provisional Patent Application Ser. No. 60/696,828, filed on Jul. 5, 2005; and (3) Ser. No. 11/455,731, entitled "Dynamic, Non Frequency Dispersive, RF Power Division by Means of Variable Dielectric Material Properties", to William S. McKinley, et al., filed on Jun. 20, 2006, which claimed priority to U.S. Provisional Patent Application Ser. No. 60/782,363, filed on Mar. 14, 2006. The specifications and claims of all above-listed applications are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to methods and apparatuses to control antenna polarization states.

2. Description of Related Art

Multiple polarization antennas are typically implemented by either mechanical switches, electronic phase shifters, or by having a dedicated feed port for each polarization. Polarization diversity can also be achieved by means of software processing to combine the orthogonal antenna polarization data sample outputs as a post processing event. Mechanical switches degrade over time and have limited high frequency applications, while electronic phase shifters are relatively expensive and many are able only to adjust phase in discrete increments resulting in some degree of polarization degradation. Defining dedicated antenna feed points for each polarization results in the disadvantage of being inefficient since the power available is divided amongst the various polarization assignments. And, because a software solution requires a post processing schedule, the results are not real time while requiring a relatively complex investment in interface technology. The present invention places all of the available power into the desired polarization and eliminates the limitations associated with mechanical switches and discrete electronic phase shifters. Furthermore, by controlling the phase in a fine analog sense, a more pure polarization sense is obtained.

BRIEF SUMMARY OF THE INVENTION

The present invention is of an antenna capable of multiple polarization states comprising: a single power input; a radiating element; a power divider receiving power from the single power input; and a plurality of transmission lines extending from the power divider to the radiating element. In the preferred embodiment, the plurality of transmission lines comprises a variable dielectric material, preferably comprising barium-strontium-titanate. The antenna additionally comprises one or more capacitors providing direct current isolation between the paraelectric material and the power output lines, preferably comprising silicon nitride. The substrate preferably comprises quartz, and the transmission lines gold. The paraelectric material is divided in sections equal in number to the number of the plurality of transmission lines, with the antenna preferably additionally comprising a plurality of bias lines providing input to the sections. The number of transmission lines is preferably two. The antenna preferably divides radio frequency power.

The invention is also of a method of creating multiple polarization states in an antenna comprising: providing to the antenna a single power input; dividing the power received from the single power input; and transmitting the divided power to a radiating element via a plurality of transmission lines. In the preferred embodiment, the plurality of transmission lines comprises a variable dielectric material, preferably comprising barium-strontium-titanate. The method preferably additionally comprises providing direct current isolation between the paraelectric material and the power output lines via one or more capacitors, most preferably comprising silicon nitride. The substrate preferably comprises quartz, the transmission lines gold. The paraelectric material is divided in sections equal in number to the number of the plurality of transmission lines. The method preferably additionally comprises biasing the sections via a plurality of bias lines. The number of transmission lines is preferably two. The method preferably divides radio frequency power.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is of an apparatus and method for obtaining multiple antenna polarization states (such as right hand circular, left hand circular, slant linear, and miscellaneous elliptical polarizations) from a single RF (radio frequency) port. By controlling the dynamic dielectric properties of paraelectric materials (such as Barium-Strontium-Titanate (BST)), the relative phases of two transmission lines feeding two orthogonal antenna polarizations can be controlled, generating various user-defined polarizations at the RF feed point.

Figure 1A:
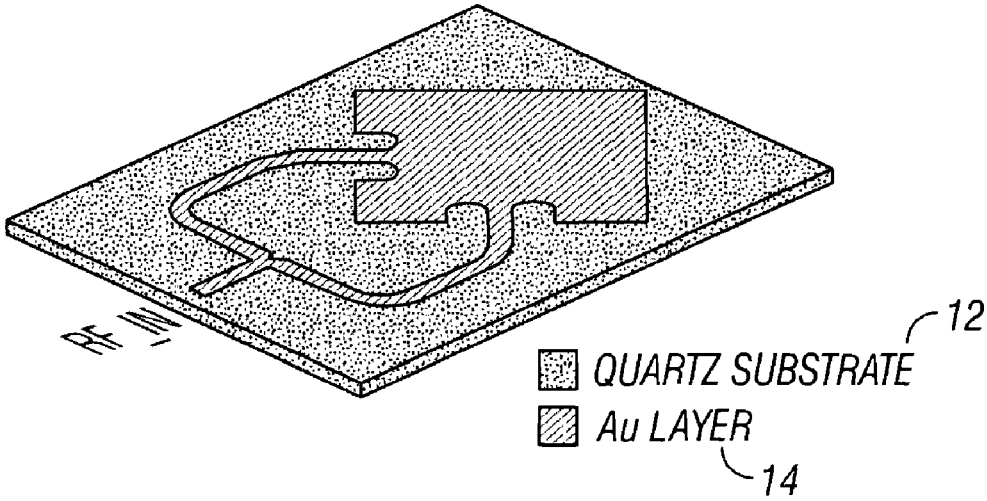
FIG. 1A (Prior Art)
FIGS. 1(*a*) and 1(*b*) are schematic diagrams of prior apparatuses generating one or two polarizations, respectively.
Figure 1B:
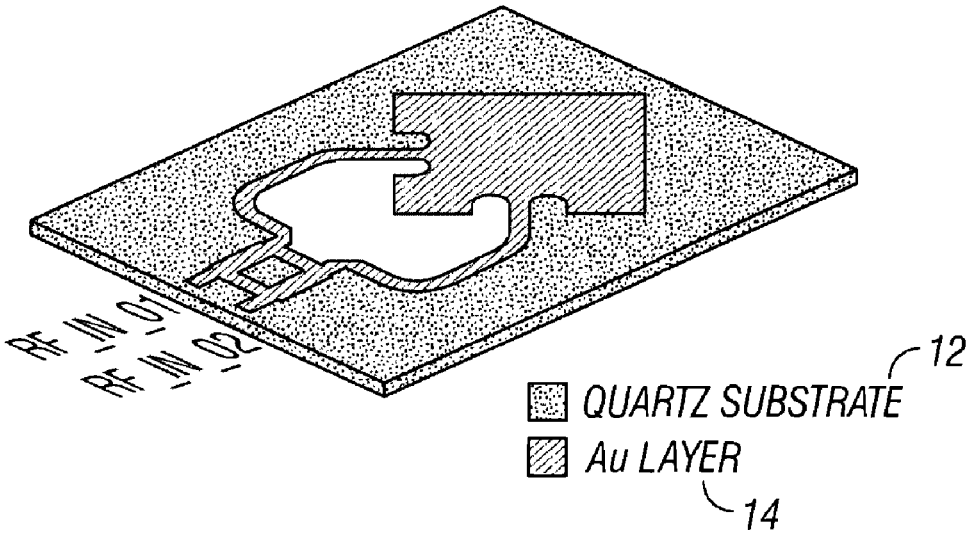
FIG. 1B (Prior Art)

As shown in FIG. 1(*a*), a typical single-input antenna will have only a single polarization (such as linear or circular) associated with it. To achieve additional polarizations, as shown in FIG. 1(*b*), two RF antenna inputs are required, with an additional disadvantage that only half the power is available for each polarization since it is split. The present invention provides a single-input device that is capable of generating multiple polarizations without splitting the power between polarizations.

The invention preferably comprises a microstrip power dividing TEE, two identical transmission lines formed upon depositions of barium-strontium-titanate (BST) having ends DC isolated by means of silicon-nitride depositions forming microwave capacitors, and an antenna element with two inputs that are used to excite simultaneously orthogonal polarizations. The constituent elements preferably reside on a common monolithic thin film substrate such as quartz, alumina, or sapphire. The two outputs from the microstrip power divider are routed over independent BST depositions and fed into the orthogonal polarization inputs of the antenna. The microstrip metal depositions routed over the BST depositions are DC (direct current) isolated from the surrounding microstrip metal by depositions of an insulating material such as silicon nitride, effectively forming DC blocks. By varying the ground referenced voltage over each BST deposition, the effective dielectric constant along the transmission lines can be varied by means of a molecular paraelectric effect. This phenomenon effectively alters the electrical phase lengths over the fixed physical lengths of the transmission lines as a function of applied voltage. By appropriately altering the relative phases of the two antenna ports in this manner, different polarizations (such as right hand circular, left hand circular, and slant linear) can be readily achieved.

Figure 2:
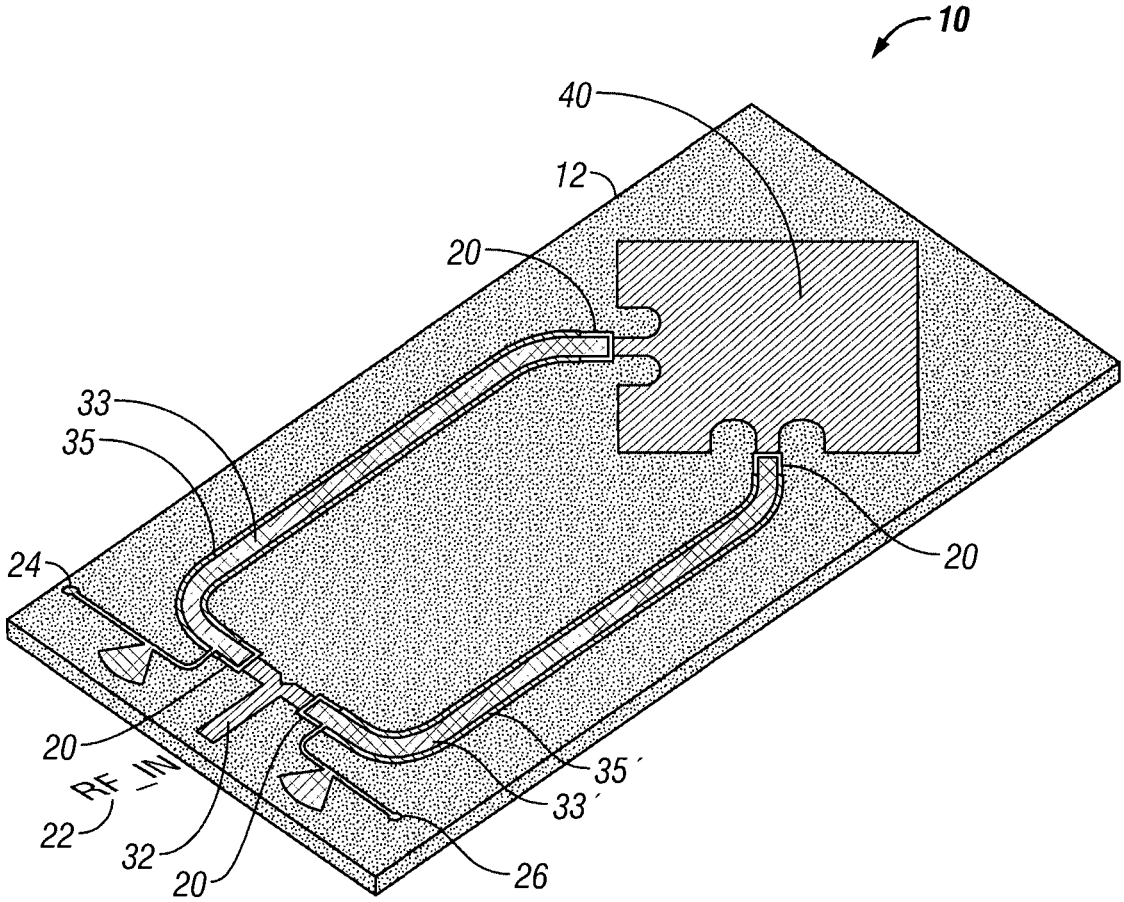
FIG. 2 is a schematic diagram of the present invention for selectively obtaining a desired antenna polarization state.

As shown in FIG. 2, the preferred apparatus 10 of the invention comprises an initial stage comprising a center-fed RF power splitter 32 receiving input from a single RF input 22, two independent transmission lines 33,33' on a variable dielectric (paraelectric) material 35,35' (such as BST). The RF power splitter preferably yields equal signal power levels on the two transmission lines. By properly altering the dielectric properties of each paraelectric BST deposition, by means of applied DC voltage via control lines 24,26, the relative phases between the two transmission lines are changed.

A dual-input antenna 40 is preferably employed. Each input to the antenna excites a polarization that is nominally orthogonal to the polarization excited by the other input, and is fed by the respective transmission line from the previous stage. One example of an antenna that meets this specification is a dual fed microstrip patch antenna, as shown in FIG. 2. Other antenna concepts would employ some form of orthomode transducer to achieve the requisite orthogonal RF relationship.

FIG. 2 also shows preferred construction materials and layers, including a base substrate 12 (e.g., quartz, alumina, sapphire), lower conductive layer 14 (e.g., gold, silver, copper), variable dielectric (paraelectric) material 16 (e.g., BST), upper conductive layer 18 (e.g., gold), and insulating capacitor material 20 (e.g., silicon nitride caps). U.S. Pat. No. 6,875,369 to Tidrow et al., dated Apr. 5, 2005, discloses examples of variable dielectric/paraelectric materials. In particular, Tidrow discloses such materials derived from BST ($Ba_{1-x}Sr_xTiO_3$) suited to the present invention.

By applying independent voltage levels across each BST transmission line, the effective dielectric constant of each line is changed. This changes the effective phase through each line, which in turn changes the polarization of the antenna. For the simplest case, the phases through each transmission line are identical. This results in an antenna with a slant linear polarization. If the phase of one transmission line is adjusted such that it leads the phase of the other line by 90 degrees, then one sense of circular polarization is achieved. Adjusting the phase of that same line to lag the phase of the second line by 90 degrees results in an antenna with the opposite sense of circular polarization. Therefore, slant linear, right-hand circular, and left-hand circular polarizations can be achieved by merely adjusting the voltage on the BST transmission lines. Some elliptical polarizations can also be generated, however, these are generally less valuable than the primary polarizations.

An additional advantage of this approach is that the relative phases of each transmission line may be adjusted in fine increments to cancel out any phase imperfections in the antenna and/or the power divider. This results in better cross-polarization isolation for the system.

The present invention exhibits reciprocal functionality and thus may be employed for both transmit and receive configurations. Additionally, all of these components can exist on a common monolithic substrate, such as quartz, thus making manufacturing easier and less costly.

The present invention is particularly useful for advanced sensors and radar and active phased arrays, or any other application where multiple antenna polarizations are desirable.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An antenna and feed network therefor configured to achieve multiple polarization states, said antenna and feed network comprising:

a single power input;

a single radiating element;

a power divider receiving power from said single power input;

a plurality of transmission lines extending from said power divider to said radiating element, wherein said plurality of transmission lines comprises a variable dielectric material, said dielectric material divided into discrete sections; and a plurality of biasing lines providing input to said discrete sections of said dielectric material.

2. The antenna of claim 1 wherein said plurality of transmission lines comprises barium-strontium-titanate.

3. The antenna of claim 1 additionally comprising one or more capacitors providing direct current isolation between said paraelectric material and said power output lines.

4. The antenna of claim 3 wherein said one or more capacitors comprise silicon nitride.

5. The antenna of claim 1 wherein said substrate comprises quartz.

6. The antenna of claim 1 wherein said transmission lines comprise gold.

7. The antenna of claim 1 wherein said dielectric material is divided in sections equal in number to the number of the plurality of transmission lines.

8. The antenna of claim 7 additionally comprising a plurality of bias lines providing input to each of said sections.

9. The antenna of claim 1 wherein said plurality numbers two.

10. The antenna of claim 1 wherein said antenna divides radio frequency power.

11. A method of creating multiple polarization states in an antenna, the method comprising the steps of:

providing to the antenna a single power input;

dividing the power received from the single power input;

transmitting the divided power to a single radiating element via a plurality of transmission lines, wherein the plurality of transmission lines comprises a variable dielectric material, said dielectric material divided into discrete sections; and applying a voltage to a biasing line in at least one of the discrete sections of the dielectric material.

12. The method of claim 11 wherein the plurality of transmission lines comprises barium-strontium-titanate.

13. The method of claim 11 additionally comprising providing direct current isolation between the paraelectric material and the power output lines via one or more capacitors.

14. The method of claim 13 wherein the one or more capacitors comprise silicon nitride.

15. The method of claim 11 wherein the substrate comprises quartz.

16. The method of claim 11 wherein the transmission lines comprise gold.

17. The method of claim 11 wherein the dielectric material is divided into discrete sections equal in number to the number of the plurality of transmission lines.

18. The method of claim 17 additionally comprising biasing each of the discrete sections via a plurality of bias lines.

19. The method of claim 11 wherein the plurality numbers two.

20. The method of claim 11 wherein the method divides radio frequency power.

* * * * *